US006164208A

United States Patent [19]

Hsu et al.

[11] Patent Number: 6,164,208

[45] Date of Patent: Dec. 26, 2000

[54] IGNITER FOR VEHICLE AIRBAG INFLATOR

[75] Inventors: Ming-Teh Hsu, Taoyuan; Long-Ming Tsai, Taipei, both of Taiwan

[73] Assignee: Chung Shan Institute of Science & Technology, Taoyuan, Taiwan

[21] Appl. No.: 09/114,878

[22] Filed: Jul. 14, 1998

[51] Int. Cl.[7] ..... F42C 19/12

[52] U.S. Cl. ..... 102/202.5; 102/202.5; 102/202.8; 102/202.9; 102/202; 102/275.11

[58] Field of Search ..... 102/202, 202.5, 102/202.8, 202.9, 206, 275.11

[56] References Cited

U.S. PATENT DOCUMENTS

| | | | |
|---|---|---|---|
| 3,570,403 | 3/1971 | Hawley et al. | 102/28 |
| 3,791,303 | 2/1974 | Sweeney et al. | 102/92.7 |
| 4,306,499 | 12/1981 | Holmes . | |
| 4,600,123 | 7/1986 | Galbraith | 102/530 |
| 4,959,011 | 9/1990 | Nilsson . | |
| 5,005,486 | 4/1991 | Lenzen | 102/531 |
| 5,140,906 | 8/1992 | Little, II . | |
| 5,230,287 | 7/1993 | Arrell, Jr. et al. | 102/202.5 |
| 5,431,101 | 7/1995 | Arrell, Jr. et al. | 102/202.5 |
| 5,454,320 | 10/1995 | Hilden et al. | 102/202.7 |
| 5,596,163 | 1/1997 | Caflisch et al. | 102/202.2 |
| 5,602,359 | 2/1997 | Hambro et al. | 102/202.5 |
| 5,648,634 | 7/1997 | Avory et al. | 102/202.1 |

FOREIGN PATENT DOCUMENTS

| | | | |
|---|---|---|---|
| 1329716 | 5/1963 | France | 102/202.5 |
| 1509181 | 1/1968 | France | 102/202.8 |
| 1590068 | 5/1970 | France | 102/202.5 |
| 2945803 | 5/1981 | Germany | 102/202.5 |
| 0026434 | of 1906 | United Kingdom . | |
| 0933742 | 8/1963 | United Kingdom | 102/202.5 |

*Primary Examiner*—Peter M. Poon
*Assistant Examiner*—Daniel J. Beitey
*Attorney, Agent, or Firm*—Bacon & Thomas, PLLC

[57] ABSTRACT

An igniter for vehicle airbag inflator includes a stainless steel casing, an ignition unit, a pyrotechnic powder holder, and a stainless steel shell, the casing defining a receiving chamber, the ignition unit being mounted in the receiving chamber within the casing, the ignition unit including a pair of electrodes, a nickel chrome wire connected between the electrodes at one end, and an electrically insulative packing block fastened to the electrodes to fix the electrodes in a separated manner, the pyrotechnic powder holder being covered on the ignition unit and holding a high burning rate pyrotechnic powder, the stainless steel shell being covered around the pyrotechnic powder holder for protecting it from damage. The igniter can be adjusted to achieve ignition time delay within 2 milli-seconds, and maximum pressure within 40~60 Bar.

9 Claims, 3 Drawing Sheets

IGNITER FOR VEHICLE AIRBAG INFLATOR

BACKGROUND OF THE INVENTION

The present invention relates to a vehicle airbag system, and more specifically to an igniter for the inflator of the airbag system of a motor vehicle.

A regular vehicle airbag system generally comprises (1) an inflator unit (which includes an igniter, a gas generating agent, and an inflator shell), (2) an air bag, (3) a cover, (4) an electronic control unit, and (5) an impact sensor. When the vehicle receives an impact force, the impact sensor outputs a signal to the electronic control unit, causing the electronic control unit to provide ignition current to the igniter. Upon receipt of ignition current, the igniter immediately ignites the gas generating agent, causing the air bag to be inflated within 30~80 milli-seconds. When the air bag is inflated, the cover is broken out suddenly, and therefore the car driver is protected. The igniter of the air bag system is required to produce a pressure about within 40~60 Bar within 2 milli-seconds, so that the gas generating agent can be ignited to deploy the air bag instantaneously. If the igniter fails, the air bag system becomes unable to function, and the driver may be injured seriously or killed when a collision occurred. If the igniter is excessively sensitive, the air bag may be caused to deploy by an erroneous signal. Therefore, the reliability of the igniter is critical.

Various igniters for vehicle air bag systems have been disclosed. Exemplars are seen in U.S. Pat. Nos. 4,306,499; 4,358,998; 4,959,011; 5,005,486; 5,140,906.

SUMMARY OF THE INVENTION

The present invention has been accomplished under the circumstances in view. It is one object of the present invention to provide an igniter for vehicle air bag inflator which is anti-electrostatic, air tight and weather proof. It is another object of the present invention to provide an igniter for vehicle air bag inflator which is highly reliable.

The igniter is operated when a constant current is applied to a nickel chrome wire, which is connected between two electrodes at one end, causing a high temperature to be produced to ignite an ignition mixture being fastened to the nickel chrome wire, and therefore a high burning rate pyrotechnic powder which surrounds the ignition mixture is burst. The design of the igniter achieves high sensitivity and high reliability. Pressure built-up time and ignition time delay as well as environmental factors such as high temperature, low temperature, heat impact, etc., have been taken into account during the design of the igniter.

An igniter according to one embodiment of the present invention is generally comprised of a stainless steel casing, an ignition unit, a pyrotechnic powder holder, and a stainless steel shell. The ignition unit is mounted in a receiving chamber defined within the stainless steel casing. The ignition unit comprises a pair of electrodes (gold plated copper rods), a nickel chrome wire connected between the electrodes at one end, and an electrically insulative packing block fastened to the electrodes to fix the electrodes in place and to insulate the electrodes from each other. The pyrotechnic powder holder is covered on the ignition unit, and holds a high burning rate pyrotechnic powder. The stainless steel shell is covered around the pyrotechnic powder holder for protecting it from damage. The electrodes of the ignition unit each are comprised of an upper metal rod and a bottom metal rod connected in a line. The upper metal rod and the bottom metal rod can be integral with each other.

Alternatively, the upper metal rod and the bottom metal rod can be separately made, and then welded together. The upper metal rod is comprised of a top end, a bottom end connected to the bottom metal rod, a first rod body connected between the top end and the bottom end, and a second rod body obliquely connected between the first rod body and the bottom end. The bottom metal rod has an expanded head at a top end thereof welded to the bottom end of the top metal rod.

DETAILED DESCRIPTION OF THE PREFERRED EMBODIMENT

Figure 1:
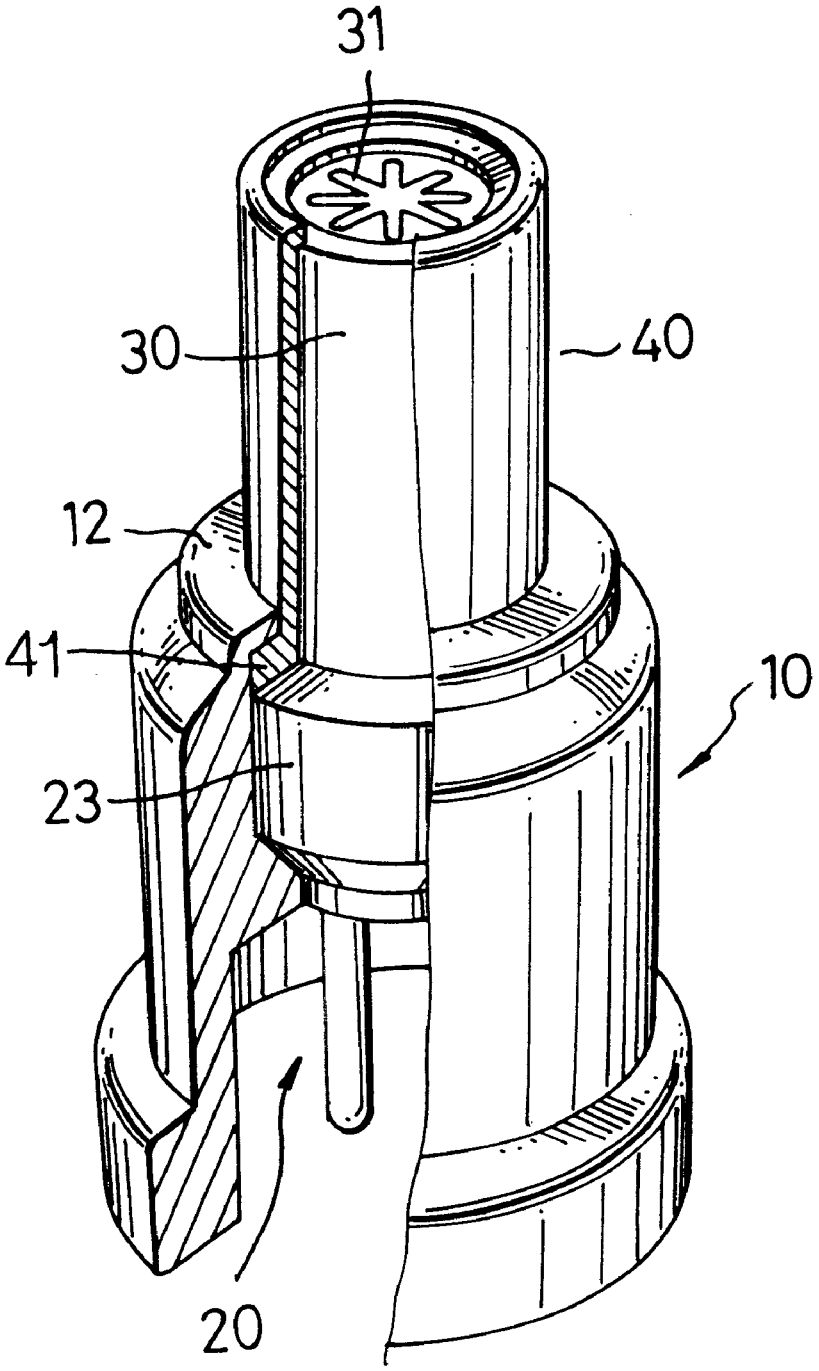
FIG. 1 is a cutaway view of an igniter for vehicle air bag inflator according to the present invention.
Figure 2:
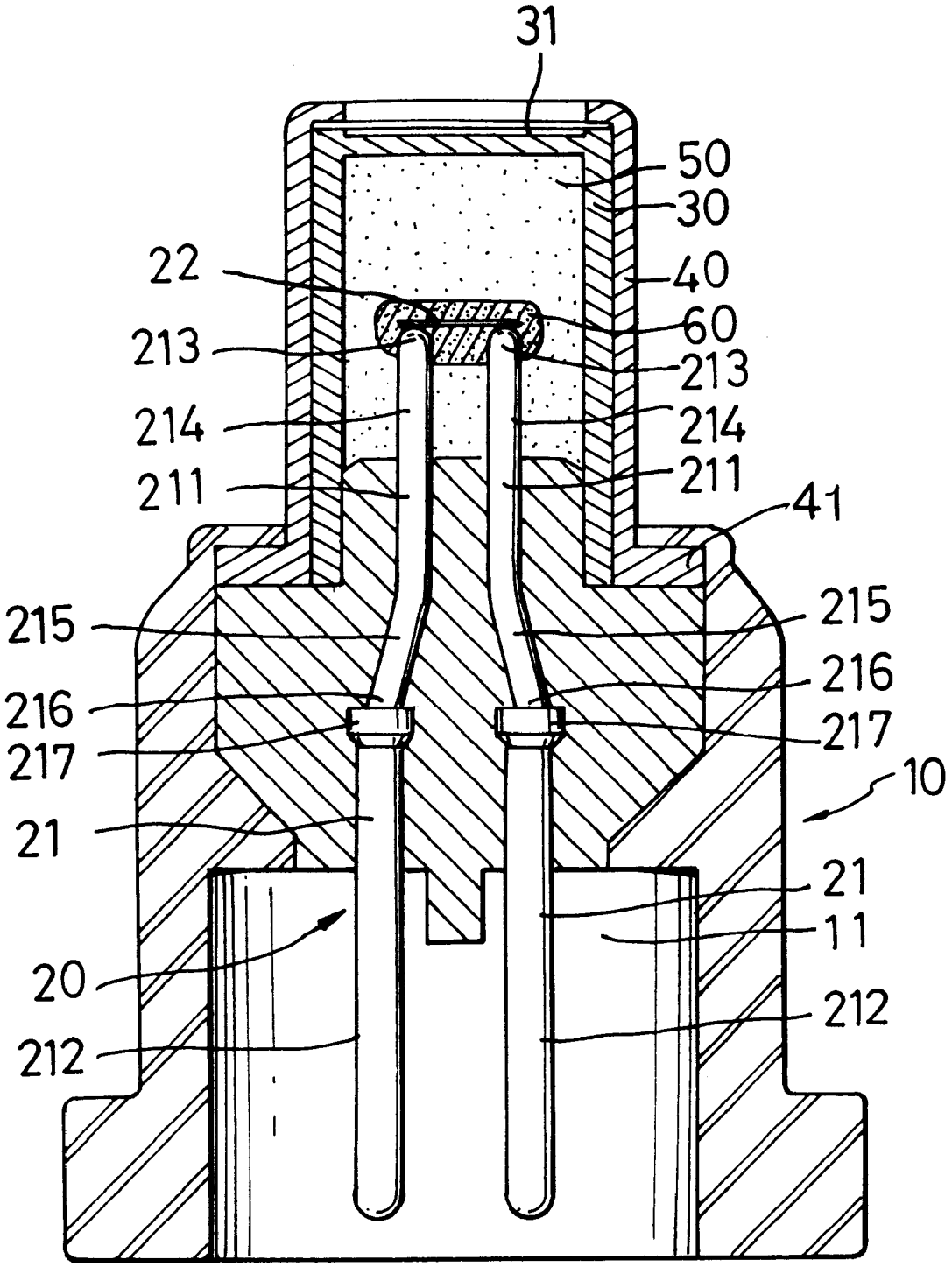
FIG. 2 is a sectional view of the igniter shown in FIG. 1.

Referring to FIGS. 1 and 2, an igniter for vehicle air bag inflator in accordance with the present invention is generally comprised of a stainless steel casing 10, an ignition unit 20, a pyrotechnic powder holder 30, and a stainless steel shell 40.

The ignition unit 20 comprises a pair of electrodes 21, a nickel chrome wire 22, and an insulative packing block 23. The electrodes 21 each are comprised of an upper metal rod 211 and a bottom metal rod 212 longitudinally welded together. The upper metal rod 211 of each electrode 21 comprises a top end 213, a bottom end 216 welded to the bottom metal rod 212, a first rod body 214 and a second rod body 215 longitudinally connected between the top end 213 and the bottom end 216. The second rod body 215 is obliquely connected between the first rod body 214 and the bottom end 216. The diameter of the bottom metal rod 212 is greater than that of the upper metal rod 211. The bottom metal rod 212 has an expanded head 217 at one end to which the bottom end 216 of the respective upper metal rod 211 is welded. The nickel chrome wire 22 is connected between the top ends 213 of the upper metal rods 211 of the electrodes 21. The insulative packing block 23 fix the electrodes 21. The insulative packing block 23 can be directly injection molded on the electrodes 21. The ignition unit 20 is mounted in a receiving chamber 11 defined within the stainless steel casing 10. The pyrotechnic powder holder 30 is covered on the ignition unit 20 a the top, and filled with a high burning rate ignition pyrotechnic powder 50. Scoring lines 31 are provided at the pyrotechnic powder holder 30 at which the pyrotechnic powder holder 30 can easily be broken. The stainless steel shell 40 is mounted around the pyrotechnic powder holder 30.

The stainless steel casing 10 has an inward coupling flange 12 around the top open side thereof. The stainless steel shell 40 has an outward bottom flange 41 engaged with the bottom edge of the coupling flange 12. The inward coupling flange 12 of the stainless steel casing 10 is formed after installation of the ignition unit 20 in the receiving chamber 11. After installation of the pyrotechnic powder holder 30 and the stainless steel shell 40, the periphery of the top open side of the stainless steel casing 10 is compressed and squeezed by a machine to form the inward coupling flange 12. After the formation of the inward coupling flange 12, the gap in the top open side of the stainless steel casing 10 around the stainless steel shell 40 is sealed.

The stainless steel casing 10 protects the ignition unit 20 from damage. The pyrotechnic powder holder 30 is preferably molded from nylon. The stainless steel shell 40 protects the pyrotechnic powder holder 30, and guides the burning direction of the pyrotechnic powder 50.

An ignition mixture 60 is fixedly fastened to the nickel chrome wire 22 in the pyrotechnic powder 50. When ignition current is guided to the nickel chrome wire 22, the ignition mixture 60 is immediately burned, thereby causing the pyrotechnic powder 50 to burn.

Because each electrode 21 is comprised of a thinner upper metal rod 211 and a thicker bottom metal rod 212, the intensity of ignition current is relatively increased when ignition current passes from the thicker bottom metal rod 212 to the thinner upper metal rod 211. Therefore, the ignition mixture 60 can be rapidly ignited.

Referring to FIG. 2 again, because the first rod bodies 214 of the upper metal rods 211 of the electrodes 21 as well as the bottom metal rods 212 of the electrodes 21 are respectively arranged in parallel and the distance between the bottom metal rods 212 of the electrodes 21 is longer than the distance between the first rod bodies 214 of the upper metal rods 211 of the electrodes 21, the bottom metal rods 212 of the electrodes 21 are closer to the stainless steel casing 10 than the first rod bodies 214 of the upper metal rods 211 of the electrodes 21. Therefore, when the human body (which carries 25000 V static electricity) touches the igniter, static electricity of the human body is discharged through the ends 216 of the upper metal rods 211. Further, because the second rod bodies 215 of the upper metal rods 211 are obliquely extended from the respective first rod bodies 214 and the bottom metal rods 212 each have an expanded head 217 at the top, the electrodes 21 will not easily be thrown out of the stainless steel casing 10 when the insulative packing block 23 is softened upon an explosion of the pyrotechnic powder 50.

The electrodes 21 are preferably gold plated, so as to achieve high electric conductivity. The nickel wire ratio of the nickel chrome wire (resistance wire) 22 is 65:35, the impedance value of the nickel chrome wire 22 is about 2 Ohms, and the diameter of the nickel chrome wire 22 is about 0.030 mm. The length of the nickel chrome wire 22 can be adjusted. The arrangement of the nickel chrome wire 22, the pyrotechnic powder 50 and the ignition mixture 60 enables the ignition to be done within 2 milli-seconds.

A vehicle air bag system has a standard short circuit loop and a power connector. The igniter of the invention is a standard design that fits regular vehicle air bag systems. The igniter provides different current values subject to the content of the pyrotechnic powder 50 and the ignition mixture 60. The ignition mixture 60 is preferably composed of 50~60% zirconium, 40~50% potassium perchlorate, a small amount of flurorubber, and a small amount of $Sb_2S_3$. The pyrotechnic powder 50 is preferably composed of 50~60% zirconium, 40~50% potassium perchlorate, and a small amount of flurorubber.

Test

Figure 3:
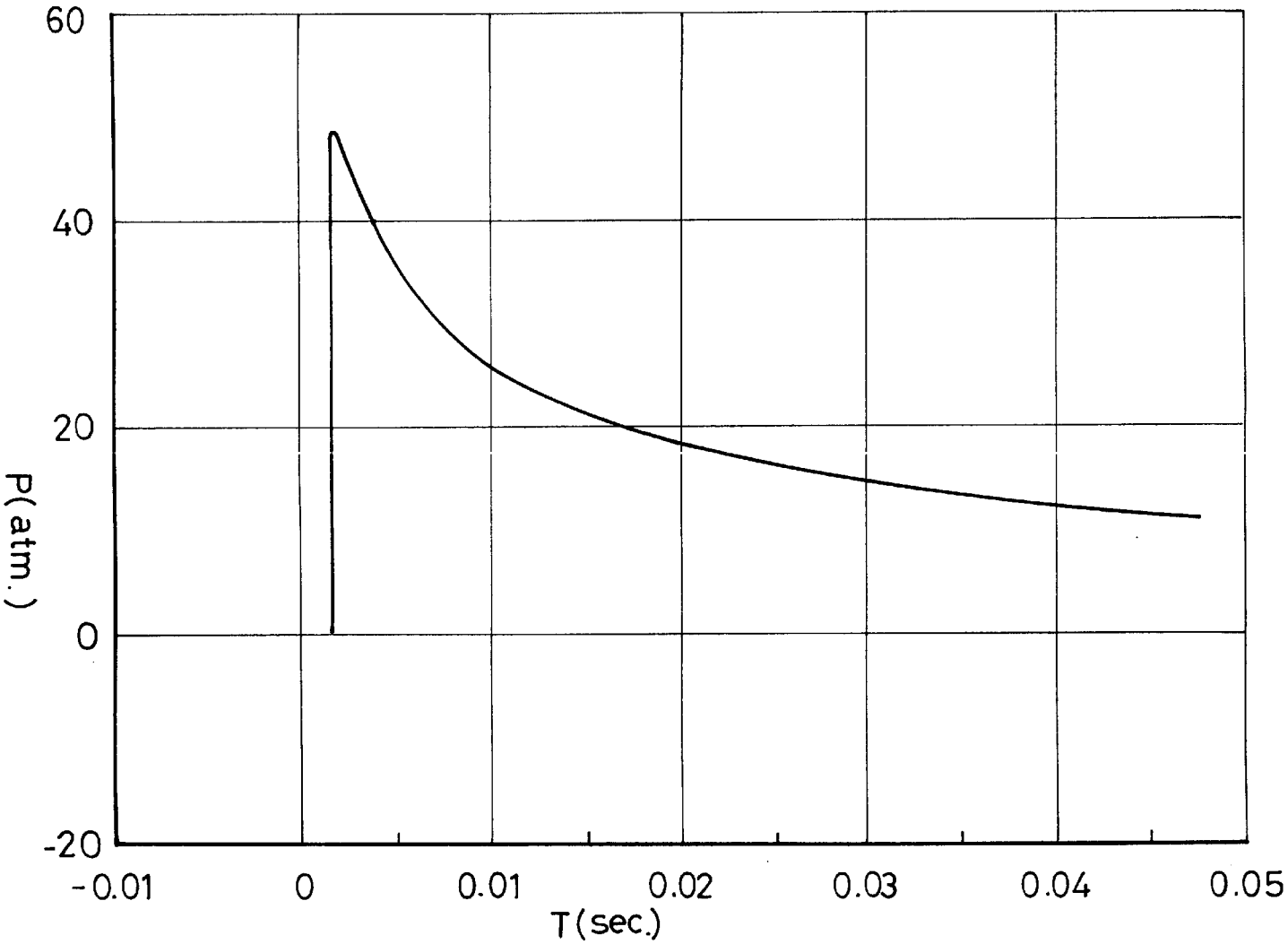
FIG. 3 is a pressure-vs-time curve obtained from a test if the present invention.

When the igniter is made, it is tested by means of Bruceton method. The test result indicates that the resistance is 2.0 Ohms, the pyrotechnic powder can be fully burned out when electric current pulse of 1.4 Amperes 3 milli-seconds passes under reliability 99%. Because an igniter for a vehicle air bag system is required to achieve the pressure of 40~60 Bar within 2 milli-seconds, the igniter of the invention is examined through a 10 cc Bomb test. FIG. 3 shows the test result of the ignition time delay and the built-up pressure.

The invention greatly improves the properties of the ignition in static electricity protection (against 25 KV), air tightness (smaller than $10^{-6}$ ml/second.atmospheric pressure), weather proof power (within 85° C.~−40° C.).

During the assembly process of the igniter, the pitch between the electrodes can be adjusted subject to different requirements. As indicated above, the design of the inward coupling flange of the stainless steel casing greatly improves the air tightness of the igniter. Because the ignition mixture is directly fastened to the nickel chrome wire (resistance wire), the ignition speed is greatly improved. The design of the scoring lines at the pyrotechnic powder holder and the arrangement of the stainless steel shell control the direction of flame. The insulative packing block improves insulative impedance. The gold plated electrodes achieve high electric conductivity. The stainless steel casing well protects the ignition unit.

While only one embodiment of the present invention has been shown and described, it will be understood that various modifications and changes could be made thereunto without departing from the spirit and scope of the invention disclosed.

What the invention claimed is:

1. An igniter used in a vehicle air bag system, comprising:

a stainless steel casing defining a receiving chamber;

an ignition unit mounted in said receiving chamber within said stainless steel casing, said ignition unit comprising a pair of electrodes, a nickel chrome wire connected between said electrodes at one end, and an electrically insulative packing block fastened to said electrodes to fix said electrodes in place and to insulate said electrodes from each other;

a pyrotechnic powder holder covered on said ignition unit and holding a high burning rate pyrotechnic powder;

a stainless steel shell mounted around the periphery of said pyrotechnic powder holder; and wherein said electrodes each are comprised of an upper metal rod and a bottom metal rod longitudinally connected together, said upper metal rod comprising a top end, a bottom end welded to said bottom metal rod, a first rod body connected between said top end and said bottom end, and a second rod body obliquely connected between said first rod body and said bottom end, said bottom metal rod having an expanded head at a top end thereof welded to the bottom end of said top metal rod.

2. The igniter of claim 1 wherein said pyrotechnic powder holder has at least one scoring line.

3. The igniter of claim 1 wherein said electrically insulative packing block is molded from nylon.

4. The igniter of claim 1 wherein said stainless steel shell has an outward flange raised around the periphery of a bottom end thereof, said stainless steel casing has an inward coupling flange at a top side thereof covered on the outward flange of said stainless steel shell.

5. The igniter of claim 1 wherein said nickel chrome wire is fixedly mounted with an ignition mixture.

6. The igniter of claim 1 wherein said electrodes are gold plated.

7. The igniter of claim 1 wherein said electrodes are made from gold platted copper alloy.

8. The igniter of claim 1 wherein the diameter of said bottom metal rod is greater than that of said upper metal rod.

9. The igniter of claim 1 wherein the first rod bodies of the upper metal rods of said electrodes and the bottom metal rods of said electrodes are respectively arranged in parallel, the distance between the bottom metal rods of said electrodes is longer than the distance between the first rod bodies of the upper metal rods of said electrodes, and the bottom metal rods of the electrodes are closer to said stainless steel casing than the first rod bodies of the upper metal rods of said electrodes.

* * * * *